US008297070B2

(12) United States Patent
Pryor

(10) Patent No.: US 8,297,070 B2
(45) Date of Patent: Oct. 30, 2012

(54) RACE CAR COOLER

(76) Inventor: Greg L. Pryor, Mt. Vernon, AR (US)

( * ) Notice: Subject to any disclaimer, the term of this patent is extended or adjusted under 35 U.S.C. 154(b) by 429 days.

(21) Appl. No.: 12/658,716

(22) Filed: Feb. 16, 2010

(65) Prior Publication Data

US 2011/0197613 A1 Aug. 18, 2011

(51) Int. Cl.
*F25D 23/12* (2006.01)

(52) U.S. Cl. ..... 62/259.3; 62/457.1

(58) Field of Classification Search ..... 62/239, 62/244, 259.3, 314, 419, 457.1, 457.9; 220/562, 220/577; 454/338, 341, 903; 165/41, 46, 165/80.1

See application file for complete search history.

(56) References Cited

U.S. PATENT DOCUMENTS

| | | | | |
|---|---|---|---|---|
| 4,459,822 | A | 7/1984 | Pasternack | |
| 5,146,757 | A | 9/1992 | Dearing | |
| 5,259,203 | A * | 11/1993 | Engel et al. | 62/150 |
| 5,539,934 | A | 7/1996 | Ponder | |
| 5,718,281 | A * | 2/1998 | Bartalone et al. | 165/41 |
| 6,105,382 | A * | 8/2000 | Reason | 62/259.3 |
| 6,109,338 | A * | 8/2000 | Butzer | 165/46 |
| 6,131,645 | A * | 10/2000 | Barr | 165/41 |
| 6,176,869 | B1 * | 1/2001 | Mason et al. | 607/104 |
| 6,510,696 | B2 * | 1/2003 | Guttman et al. | 62/3.3 |
| 6,715,309 | B1 | 4/2004 | Jukins | |
| 6,871,675 | B1 * | 3/2005 | Marszalec et al. | 141/82 |
| 6,886,360 | B1 * | 5/2005 | Rosenbaum et al. | 62/424 |
| 7,155,924 | B2 * | 1/2007 | Zuckerman et al. | 62/424 |
| 7,266,965 | B2 * | 9/2007 | Blackstone | 62/259.3 |
| 7,302,808 | B1 * | 12/2007 | Teetzel et al. | 62/259.3 |
| 7,406,834 | B2 * | 8/2008 | Williams | 62/115 |
| 7,465,375 | B2 * | 12/2008 | Demers et al. | 202/160 |
| 7,476,455 | B2 * | 1/2009 | Edlund | 429/404 |
| 7,640,765 | B2 * | 1/2010 | Chiu et al. | 62/259.3 |
| 7,731,244 | B2 * | 6/2010 | Miros et al. | 285/317 |
| 7,827,620 | B2 * | 11/2010 | Feher | 2/171.3 |
| 2004/0055072 | A1 * | 3/2004 | Lee | 2/171 |
| 2004/0074250 | A1 | 4/2004 | Jukins | |
| 2004/0082057 | A1 * | 4/2004 | Alford et al. | 435/284.1 |
| 2006/0033674 | A1 * | 2/2006 | Essig et al. | 343/912 |
| 2007/0044503 | A1 | 3/2007 | McCarrell | |
| 2008/0155991 | A1 | 7/2008 | Lee | |
| 2009/0291486 | A1 * | 11/2009 | Wenrich | 435/284.1 |
| 2010/0005572 | A1 * | 1/2010 | Chaplin | 2/411 |

* cited by examiner

*Primary Examiner* — Mohammad Ali
(74) *Attorney, Agent, or Firm* — Stephen D. Carver

(57) ABSTRACT

A portable, self-contained race car cooler comprises an enclosure divided interiorly by vented baffles into separate cooling and fan compartments. A removable top covers the enclosure. Air is drawn through the enclosure and between adjacent cooling compartments by an electric fan. A plurality of removable canisters, frictionally fitted through orifices in the top, store "dry ice" for cooling. Each canister is peripherally restrained by a plurality of radially spaced-apart J-hooks emanating from the top that are biased inwardly by an elastic band. The J-hooks peripherally grasp the canisters and provide a detent for snappingly engaging or releasing the canisters. A heat-exchange standoff is secured beneath each canister upon the enclosure floor and comprises a plurality of spaced-apart, parallel rails with air passageways defined between them. Cooler lids removably coupled to the canisters are externally serviceable. Carbon dioxide venting is provided.

20 Claims, 13 Drawing Sheets

RACE CAR COOLER

BACKGROUND OF THE INVENTION

1. Field of the Invention

The present invention relates generally to portable cooling systems for use in a racing environment. More particularly, the present invention relates to portable cooling systems that intake ambient air for treatment within a heat exchanger and direct cooled air into a race car driver's helmet or racing suit.

2. Description of the Related Art

The popularity of American stock-car racing, as exemplified by NASCAR for example, continues to increase. Highly sophisticated race-cars with high performance engines developing several hundred horsepower at engine speeds approaching ten-thousand RPM are ubiquitous, both I asphalt racing and the much-more common phenomena of dirt tract stock car racing. Obviously such engines develop considerable heat. The interior of modern racecars can reach temperatures over 120 degrees F. Where speed is at a premium, creature comforts for the driver are notably absent. Racecars do not include air conditioners, or other common automotive creature comforts, which are regarded by professional race teams as energy wasting frills. During a hot Sunday afternoon NASCAR race, involving hundreds of high speed laps over an asphalt race track, car drivers are subject to demanding physical requirements, including the prolonged exposure to potentially debilitating heat.

The avoidance of fatigue, and the necessity to keep the drivers "sharp" cannot be overemphasized. With crowded tracks, heavy traffic, and demanding speeds winning drivers must maintain their concentration and physical dexterity. It is well recognized that drivers subject to long periods of heat, particularly during hot, summer afternoon racing, are subject to deteriorating reflexes, and impaired concentration. Driver fatigue and heat exhaustion contribute to errors in judgment that are especially critical during long races at high speeds in hot summer weather. Although driver's are provided with various safety measures, such as protective suits and helmets, heat dissipation has been only marginally addressed.

Prior attempts at cooling racecar drivers include cooling containers placed within the racecar. Frozen gel coolant within the containers provides cooling. An air inlet vented to the racecar exterior inputs pressurized air that is cooled via heat exchange. An outlet communicates through a hose to the helmet. Cooled air is reduced in temperature about twenty degrees. Known devices of this type suffer from several disadvantages.

U.S. Pat. No. 4,459,822 issued Jul. 17, 1984 discloses a cooling suit comprising a cooling media flow conduit for circulating a cooling media. A heat exchanger associated with the suit includes an insert connected to a heat exchanger. The insert is filled with ice. Liquid cooled by the ice is circulated by a pump.

U.S. Pat. No. 5,146,757 issued Sep. 15, 1992 discloses a helmet cooling system utilizing a coolant-filled receptacle through which air flows. Forced airflow results from the sheer velocity of the racecar. Air ducted from the receptacle to the interior of the helmet provides cooling. A flexible conduit transmits melted coolant to a mouthpiece within the helmet for refreshing the helmet wearer.

U.S. Pat. No. 5,539,934 issued Jul. 30, 1996 discloses a protective helmet cooled by an auxiliary bladder filled with a breakable pouch of encapsulated ammonium salt surrounded by water. A chamber in the bladder allows free communication of the cooling medium within the chamber to allow for different heat loads at different areas of the bladder.

U.S. Pat. No. 6,715,309 issued Apr. 6, 2004, which is related to U.S. Pat. Application No. 2004/0074250 published Apr. 22, 2004, discloses a cooling apparatus with an insulated tank defining a refrigerant chamber. A circulation system circulates air to be cooled by the refrigerant chamber to a discharge unit. The circulation system comprises first and second tube coils, a pump, and hoses for conveying coolant from the first tube coil to the second tube coil and back to the pump. The unit can be harnessed to a user as a backpack and the discharge unit can be a helmet worn by the user. The refrigerant supplied to the refrigerant chamber can be ice and the coolant flowing through the closed circulation system can be water.

U.S. Pat. Application No. 20070044503 published Mar. 1, 2007 discloses a multifunction cooler that functions as a portable refrigeration device, a personal air conditioner, or a portable air inflation device. The cooler incorporates an air injection port that permits external warm air to be forced through ice or other coolant material inside the cooler. The air injection is facilitated by an electric fan which vents air from within the coldest portions of the interior of the cooler to an exhaust port which may be used as a source of air conditioning.

U.S. Pat. Application No. 2008/0155991 published Jul. 3, 2008 discloses a cooled helmet comprising a shell and a cooling module. The cooling module includes a thermoelectric cooler. A heat pipe embedded in the shell comprises an evaporating section and a condensing section. The thermoelectric cooler includes a cold end brought into contact with the condensing section of the heat pipe, a hot end exposed to the exterior of the shell, and an array of semiconductor elements sandwiched between the cold end and the hot end. The film type solar cell supplies electric energy to the thermoelectric cooler.

U.S. Pat. Application No. 2008/0302119 published Dec. 11, 2008 discloses a system for refrigerating air flowing into a race car and delivering it to the driver seat, the helmet or driver's suit, and/or other locations within the cockpit. An insulated coolant container with inflow and outflow ports connected to a delivery conduit receives fresh air from the vehicle's air intake system and directs it through a conduit system, such as coiled cooper tubing surrounded by dry ice, thus refrigerating the air.

Since on-board power sources are unavailable as a practical matter on modern racecars, viable coolers must have an adequate self-contained power supply. More particularly, a "quick-change" coolant storage arrangement is needed to minimize the complexity and time commitment needed for maintenance. Of course, care must be taken to maximize safety, as well as reliability.

BRIEF SUMMARY OF THE INVENTION

My new race car cooler provides a portable, self-contained cooling apparatus, that is ideal for race car drivers. Cooling is provided by stored, carbon-dioxide (i.e., "dry ice") disposed within separate, spaced apart canisters that are removably coupled to a housing. No compressors or associated hydrocarbon refrigerants are needed with the design.

The preferred cooler comprises a portable, box-like enclosure defining an interior, a removable top normally covering the interior, and an air inlet and air outlet in fluid flow communication through the interior. The interior is divided into separate compartments by internal baffles that include ventilation apertures. Preferably a fan draws air through the inlet, throughout the enclosure interior, and outputs cooled air through the outlet via a hose to the driver's helmet or racing suit. A small battery powers the fan. Preferably the fan and the battery are mounted within a small subcompartment adjacent the enclosure that is easily serviced when necessary without opening the enclosure.

Preferably the cooler interior is divided by baffles into three separate cooling compartments. A canister is fitted through the removable top into each cooling compartment below. The canisters penetrate spaced-apart orifices defined in the enclosure top, and are frictionally gripped about their periphery by spring loaded receptacles that hold the canisters. The receptacles, comprising vertically oriented J-hooks encircled at their bottoms by an elastic band, provide a detent for snap-fitting the canisters into place when installed. Air is drawn through vent holes in bordering baffles between adjacent compartments.

Preferably dry ice is used as the coolant. Alternatively, coolant gels, gel packs, or common ice can be used. The coolant is stored within the separate, spaced-apart canisters. The canisters penetrate spaced-apart orifices defined in the enclosure top, and are frictionally gripped about their periphery by the radially spaced-apart J-hooks whose curved bottoms support an elastic retainer. The canisters are preferably supported within the cooler by heat exchange standoffs rising from the enclosure floor. Thus the canister bodies are normally operationally disposed within the enclosure, but they can be quickly removed and replaced during service or refilling. Cooler lids are removably coupled to the canister bodies and are externally serviceable without dissembling the enclosure.

Preferably the spaced-apart mounting orifices, and thus the canisters penetrating them, are arranged off-center to form a serpentine air path through the enclosure interior. Efficient heat exchange is encouraged by the air path, which is in part defined by separate air baffles within the enclosure supplementing the circuitous air path between spaced apart canisters.

The canister standoffs are secured upon the enclosure floor beneath the canisters. Preferably each canister standoff comprises a plurality of spaced-apart, parallel rails with air passageways defined between them. The rails contact bottoms of the canisters for support. Further, the standoff air passages enhance heat exchange. Preferably, the canisters are further braced by an encircling array of J-hooks projecting downwardly from the top into the cooler interior. The J-hooks coaxially surround the canisters, and the encircling elastic band causes the J-hooks to grasp and restrain the canisters. The J-hooks resiliently grasp and support the canisters, while promoting heat exchange through conduction.

Other amenities include a system for removing condensate from the enclosure interior as condensate from humid air accumulates within the enclosure. Further, a carbon dioxide gas venting system is associated with each canister.

Thus a basic object of my invention is to provide a portable cooler for racecar drivers.

Similarly, it is an object to provide a portable, self-contained cooling apparatus for race car drivers that functions without electrical interconnection with the racecar.

Another basic object is to provide a cooler of the character described that adequately cools the driver throughout a race, whether "at speed", driving slowing during yellow flag conditions, pitted, or fully stopped.

It is also an object to provide a cooler suitable for race conditions that functions adequately without compressors, or high pressure refrigerants.

A further object is to provide a cooler of the character described that can use regular ice instead of dry ice where conditions warrant it.

A related object is to provide a cooler of minimum size and weight that offers maximum cooling potential for a racecar driver, without design "overkill" that adds unnecessary weight, volume or complexity. It is a feature of my invention that the coolant capacity can be user-selected and tailored for a given race. In this manner excess weight is avoided and reliability is maximized.

Another important object is to provide a cooler for racecars that does not depend on available electricity or car accessories, and that will function even when the car is running slowly (i.e., during a yellow flag) or stopped altogether. Suitable battery power for an internal fan system is an important feature of my preferred design.

Another important object is to maximize cooling potential and cooling longevity by providing enhanced handling of the dry-ice or carbon-dioxide cooling media. It is a feature of my invention that multiple, independent canisters that are quickly, externally serviceable without special tools or time consuming adjustments are employed for storing dry ice.

Another basic object is to provide a heat exchange utilizing dry ice that has an adequate capacity for performance during long races, but which may be quickly recharged where circumstances demand it.

Another important object is to safely contain dry-ice within separate containers disposed within a heat-exchange relationship, and to properly ventilate carbon dioxide gases that otherwise accumulate during use.

A further object is to provide a cooler of the character described that can be used with a wide variety of different racecars that compete either on dirt or asphalt surfaces.

A related object is to provide a cooler of the character described that can quickly be recharged if necessary during a very short time period.

A related object is to reliably grasp cooling canisters within a cooler. It is a feature of my invention that the preferred canisters are snap-fitted into a retainer arrangement, comprising multiple J-hooks that peripherally surround the canisters and which snap into engagement about the canisters when a lower canister ip passes by the lower J-hook structure.

A related object is to provide a cooler of the character disclosed whose canister bodies are normally operationally disposed within suitable receptacles, but can be quickly removed and replaced during service or refilling.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE SEVERAL VIEWS OF THE DRAWINGS

Figure 1:
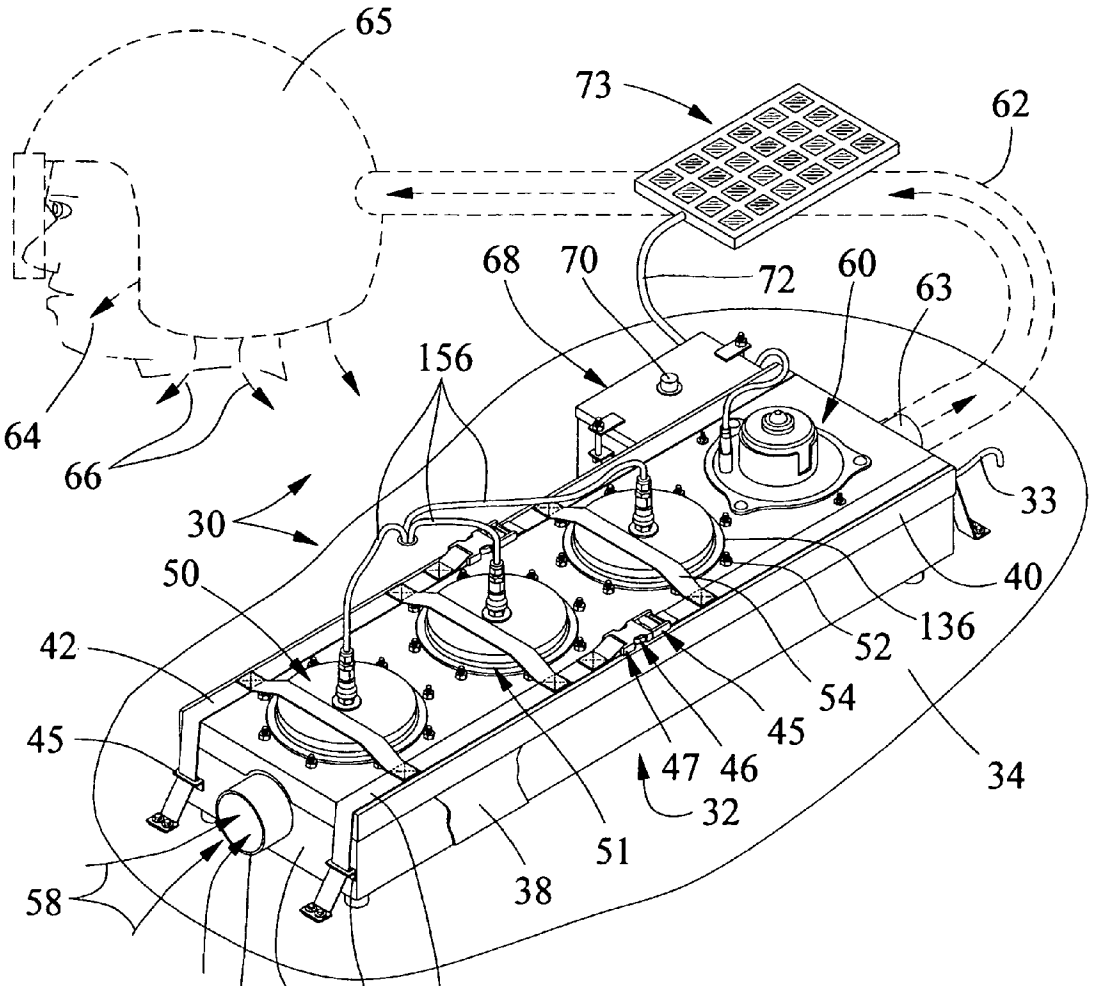
FIG. 1 is a fragmentary, isometric and diagrammatic view of the best mode of my race car cooler.

With initial reference directed to FIGS. 1-4 of the appended drawings, a race car cooler system constructed generally in accordance with the best mode of the invention has been generally designated by the reference numeral 30. The cooler enclosure 32 is generally in the form of a parallelepiped, and it preferably rests on the floor of the race car upon an insulation sheet 34. Enclosure 32 comprises a base compartment 36 (i.e., FIGS. 2, 5) and a removable, generally rectangular cover 40. The rigid, generally rectangular base compartment 36 is preferably substantially covered with insulation 38. Preferably the insulation is made from Thinsulate-brand material. The top of the enclosure 32 is formed by the rectangular cover 40 removably secured atop base 36. Cover 40 mounts cooling components described later. In the best mode insulation 38 shown on the side of the bottom box also covers the base sides 37, ends 48 and 49, and the bottom of the base. Insulation material preferably extends up all sides to the bottom edge of the cover 40.

Figure 9:
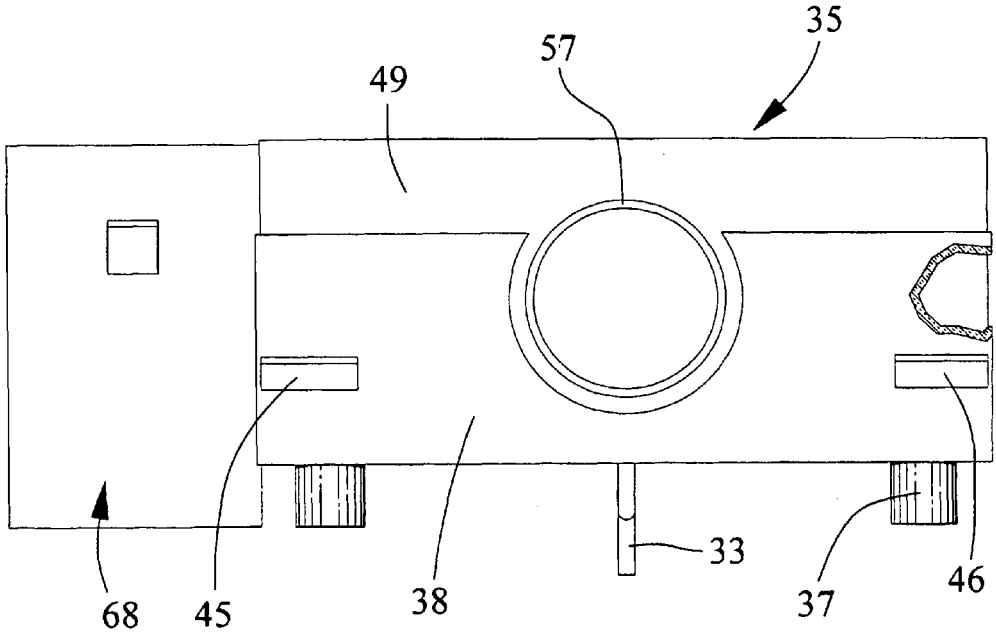
FIG. 9 is an enlarged, left end elevational view.
Figure 10:
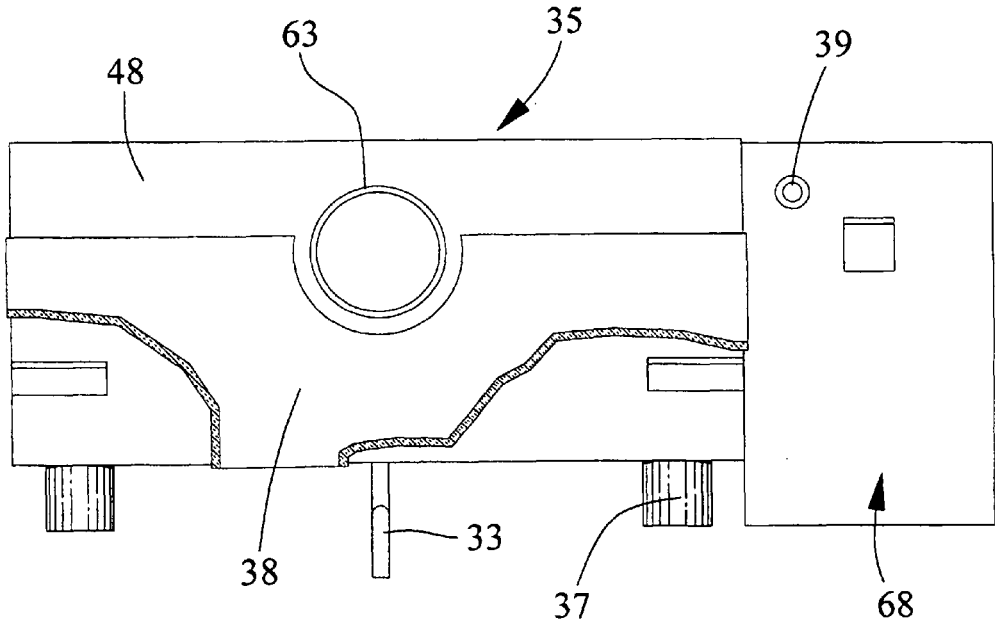
FIG. 10 is an enlarged, right end elevational view.
Figures 11, 12, 13:
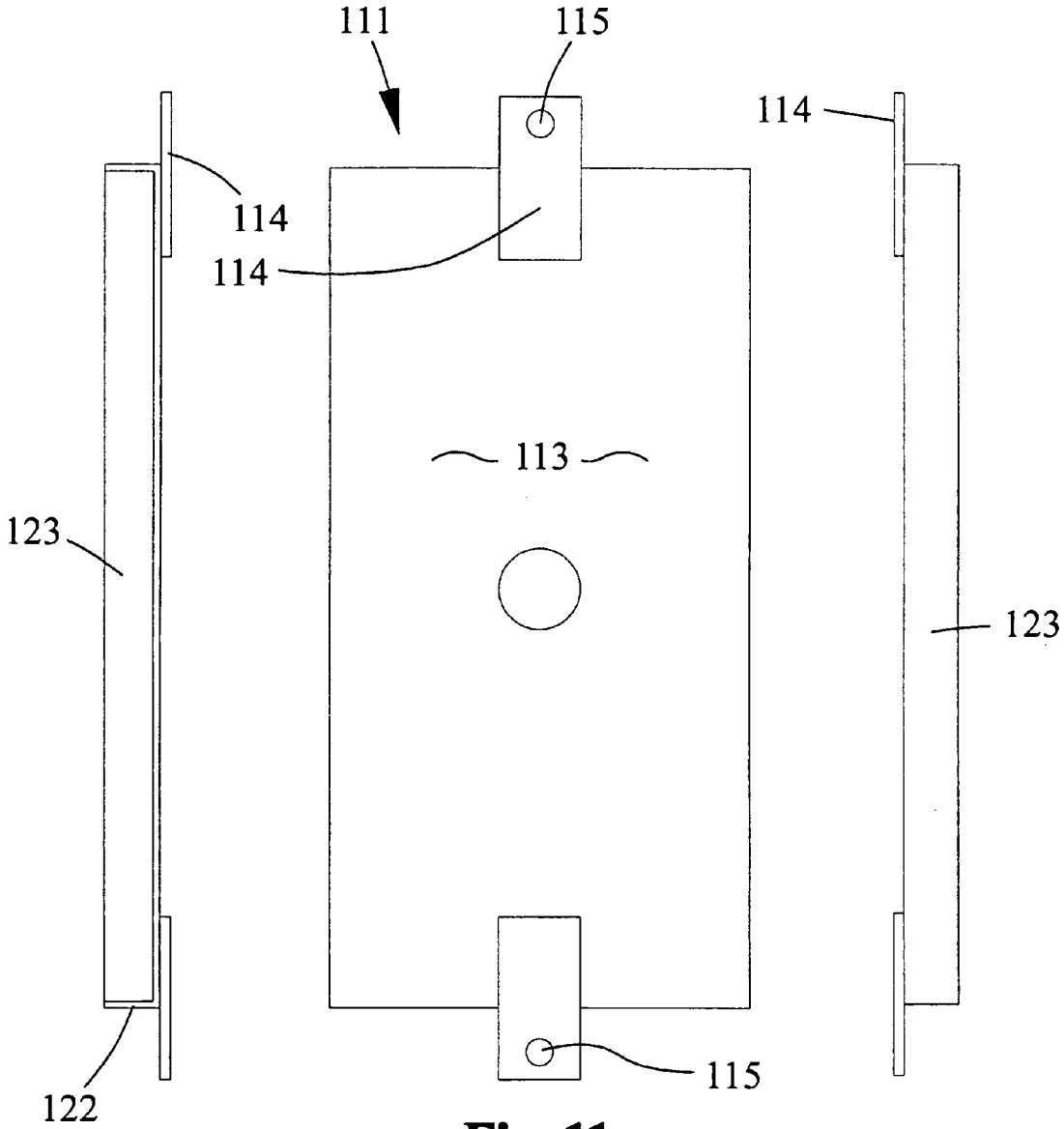
FIG. 11 is a top plan view of the preferred battery compartment lid.
FIG. 12 is a left side elevational view of the lid.
FIG. 13 is a right side elevational view of the lid.
Figure 14:
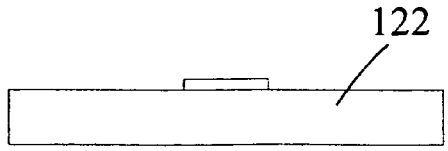
FIG. 14 is a bottom end elevational view of the lid, the top end comprising a mirror image.
Figure 15:
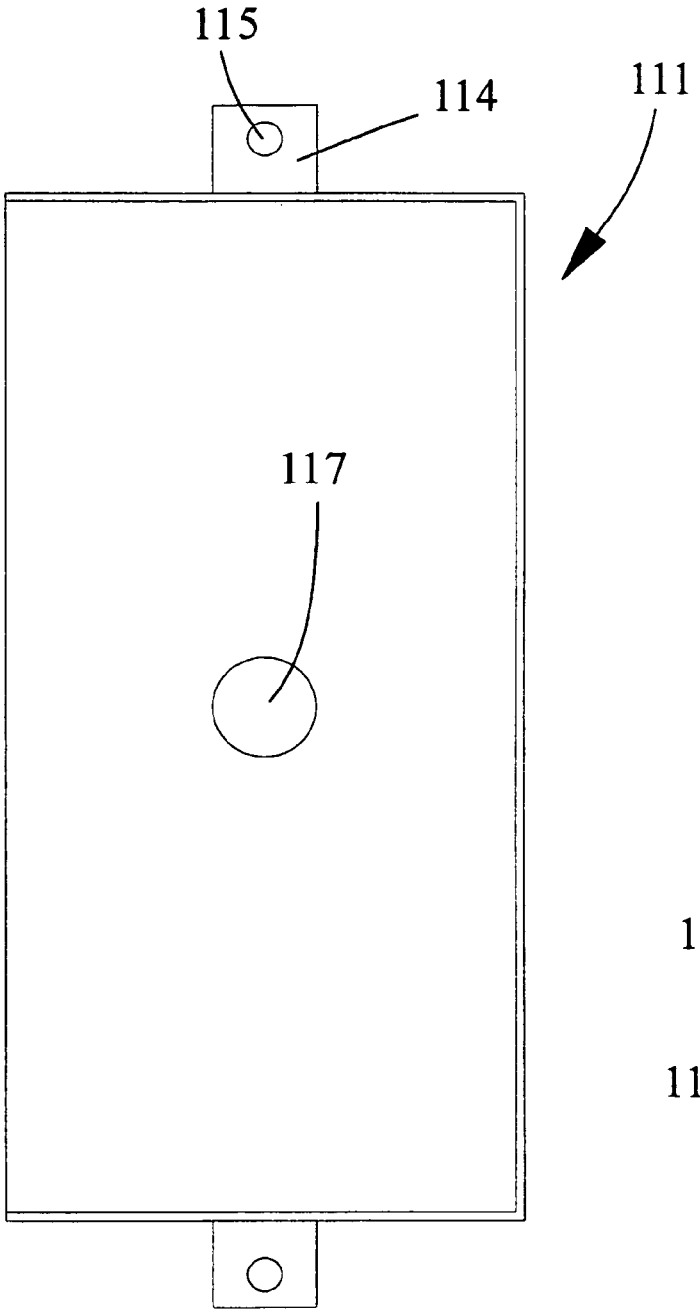
FIG. 15 is a bottom plan view of the lid.
Figure 16:
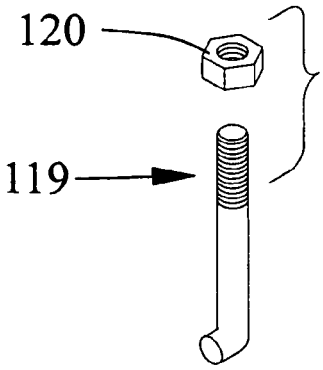
FIG. 16 is a exploded isometric view of a preferred J-hook used for mounting the cooler top.
Figure 17:
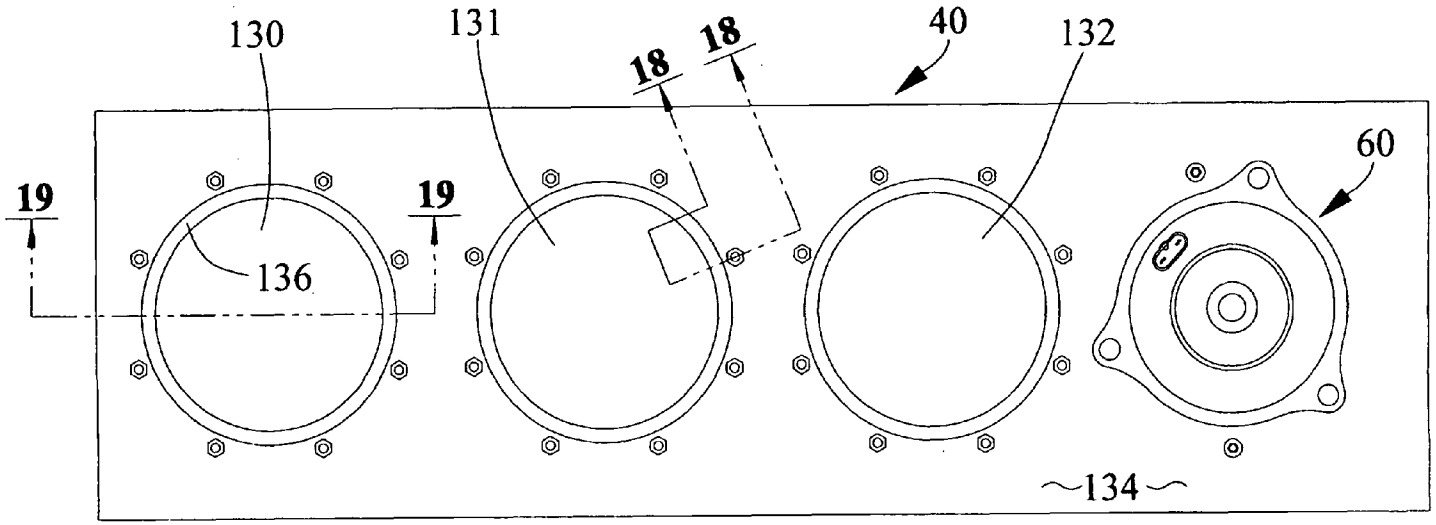
FIG. 17 is a top plan view of the preferred removable housing cover.
Figure 18:
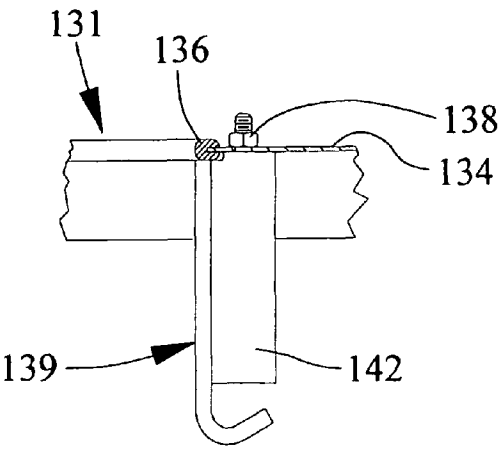
FIG. 18 is an enlarged fragmentary sectional view of the housing cover taken generally along line 18-18 of FIG. 17.

Cover 40 is preferably removably attached atop base 36 by a pair of elongated straps 42, 43 that extend along the top of opposite sides of the cover, between friction clasps 45, 46 secured to opposite ends 48, 49 of the base (i.e., FIG. 9). Quick release, snap buckles 47 midway along the length of the straps 42, 43 enable the straps to be quickly unconnected or connected for servicing the removable cover 40. A plurality of removable cooling canisters 50, 51, 52 (preferably three) that are spaced apart along the upper surface of cover 40. Each of the canisters 50-52 is filled with dry ice in the best mode for cooling, but regular ice or frozen cooling blocks can be used. Preferably each canister is secured on the top of cover 40 by transverse belts 54 that extend transversely across cover 40 between straps 42, 43.

A tubular hose coupling 57 defined in the end 48 of the base admits air into the enclosure 32, as indicated diagrammatically by arrows 58. Coupling 57 may be connected to an auxiliary air intake hose (not shown) that may lead to an air filter, an air vent or the like. Air is drawn into and through the body of the cooler by a conventional D.C. electric fan assembly 60 mounted atop cover 40. Air passing through the body of the cooler is cooled by contact with the multiple cold canisters 50-52, and exits through an elongated hose 62 fastened to a coupling 63 in the opposite end 49 (FIG. 2) of the enclosure base 36. Hose 62 may be directed to the race car driver's helmet 65 or alternatively, to his or her racing suit. Air exiting hose 62 and passing by the head or body of the driver 64 has been diagrammatically designated by the reference numeral 66. Fan assembly 60 is powered by a battery box 68 that is controlled by a conveniently located push button switch 70. Batteries within box 68, discussed hereinafter, are connected to recharge line 72 and are preferably recharged by a conventional solar panel 73 (FIG. 1).

Figure 2:
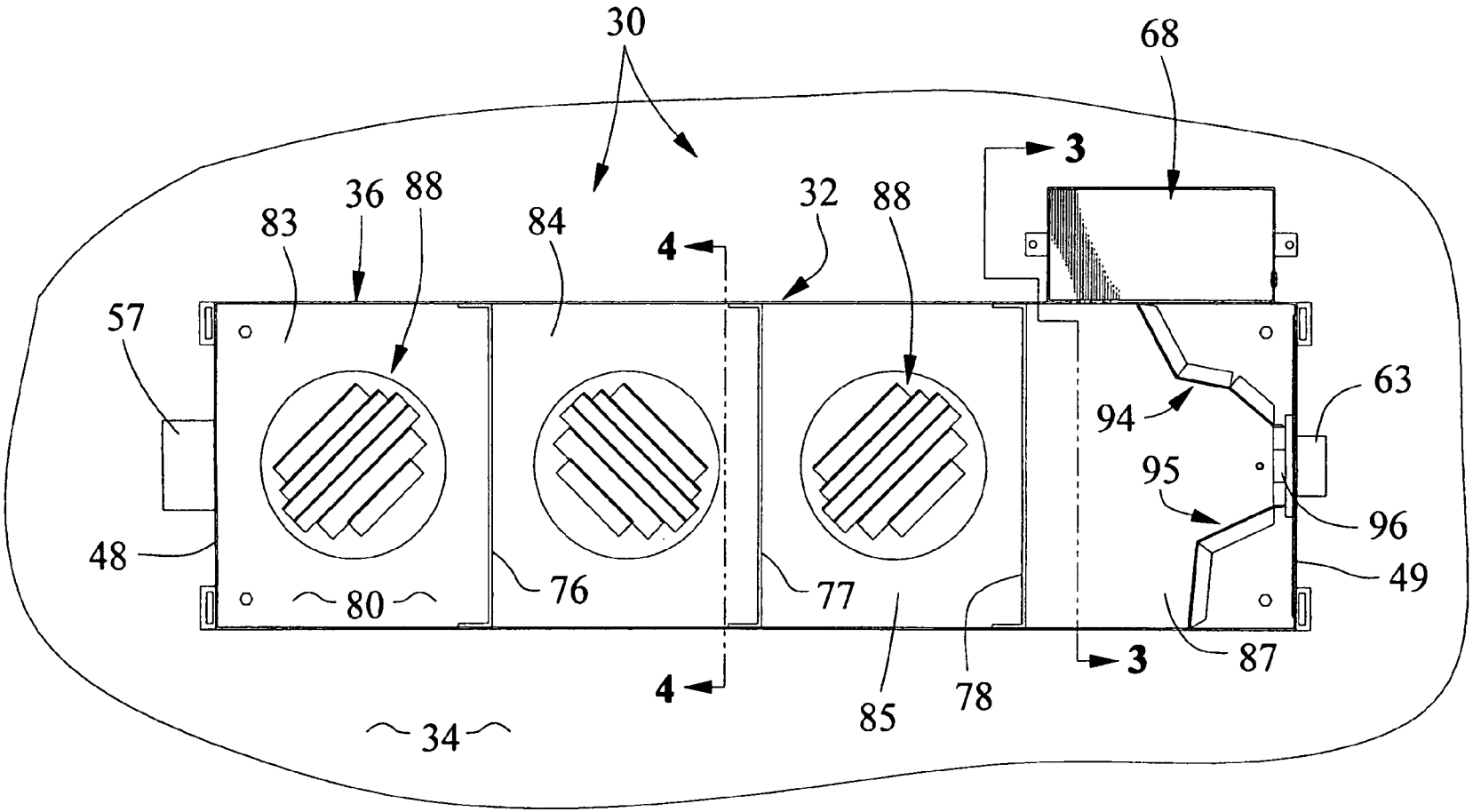
FIG. 2 is a top plan view of the cooler.
Figure 3:
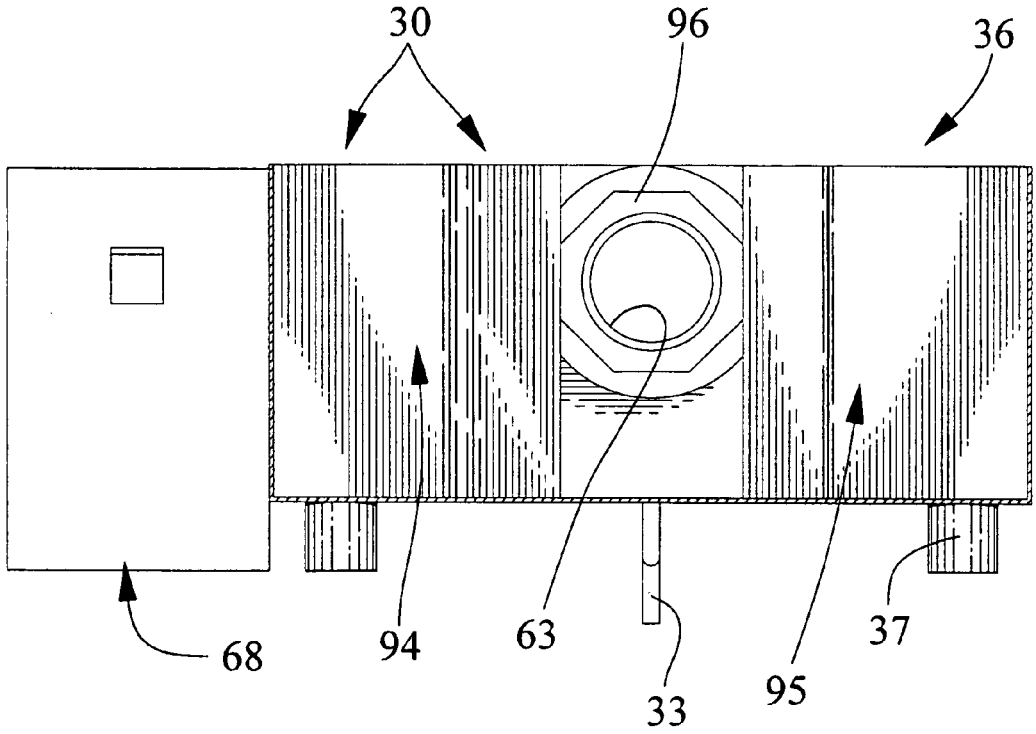
FIG. 3 is an enlarged sectional view taken generally along line 3-3 of FIG. 2.
Figure 4:
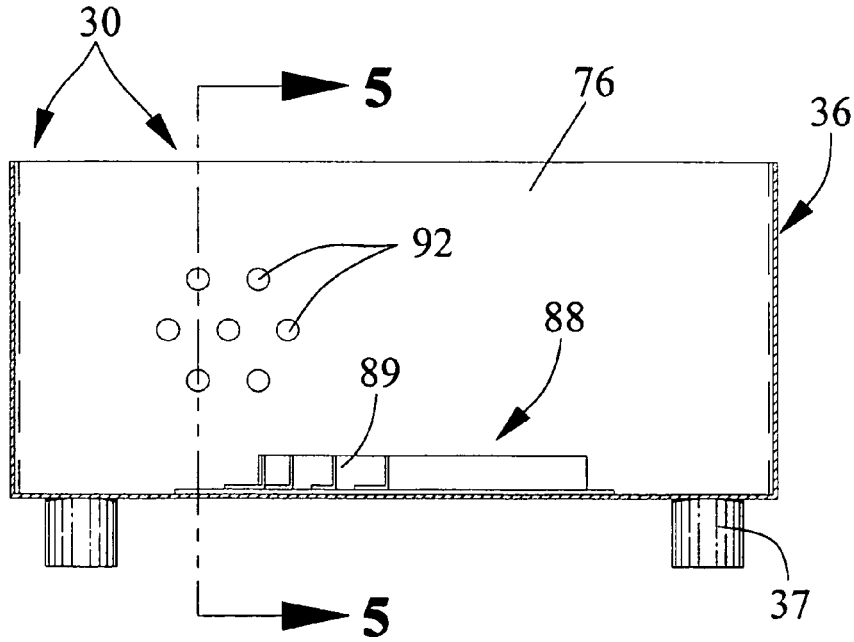
FIG. 4 is an enlarged sectional view taken generally along line 4-4 of FIG. 2.

With primary reference now directed to FIGS. 2-4 and 7-10, the insides of the base 36 are divided by spaced apart baffles 76, 77, 78 that comprises upright metallic panels that extend vertically upwardly from base floor 80 (FIG. 2) coextensive with the dimensions of ends 48, 49. Cooling compartments 83, 84 and 85 contain the cooling canisters 50, 51, and 52 respectively. The adjacent, similarly-sized fan compartment 87 (FIG. 2) contains the fan assembly 60. Each cooling compartment 83, 84, 85 has a louver array 88 forming a heat exchanger and standoff that is approximately centered on floor 80 (FIG. 2). As best seen in FIG. 4, the louver assembly comprises a plurality of spaced apart, parallel and generally L-shaped strips 89 that promote heat exchange with air drawn through the interior. These are cooled by the cooling compartment, and by liquid condensation that accumulates within the interior during operation. Each of the baffles 76, 77, and 78 comprise a group of venting holes 92 (FIG. 4) through which air flows when traveling through and between adjacent compartments 83, 84, and 85. The vent holes 92 are grouped together on the left of baffle 76, as viewed in FIG. 4, but they can be located on the right side of baffle 77, and on the left side of baffle 78, such that different groups of holes on one baffle are offset from the centerline of the cooler a different amount to form a serpentine air path. Alternatively the cooling orifices can all be grouped in the center of their respective baffle plates.

With joint reference directed now to FIGS. 2 and 3, the fan compartment is bounded by baffle 78 on one side and by diagonally extending shrouds 94, 95. These segments channel air flow from compartment 87 to the flanged fitting 96 by which the outlet coupling 63 is secured to end 49.

Figure 5:
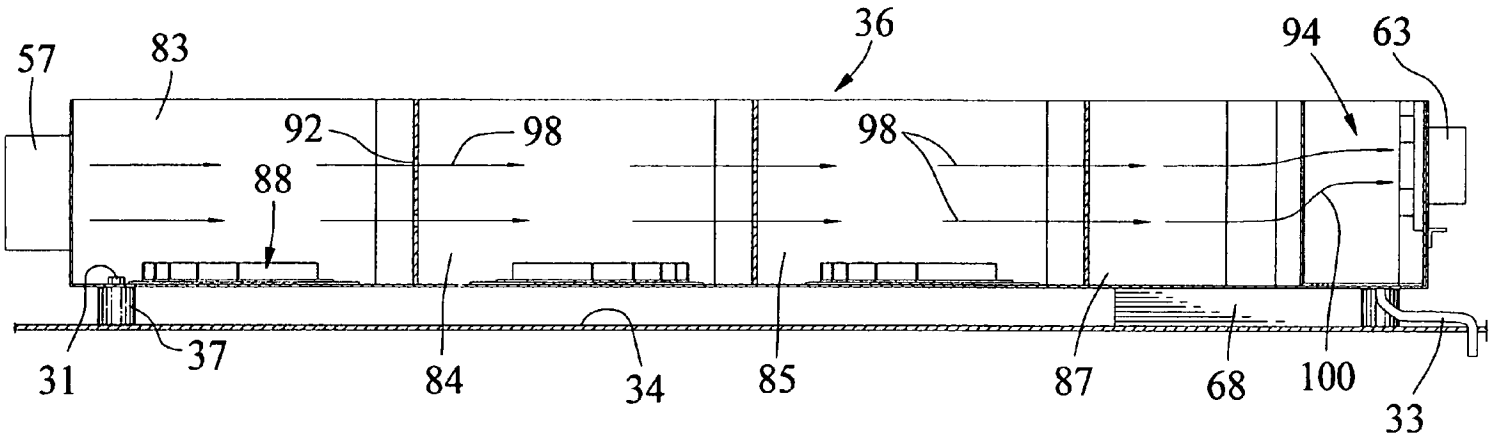
FIG. 5 is a longitudinal sectional view taken generally along line 5-5 of FIG. 4.
Figure 6:
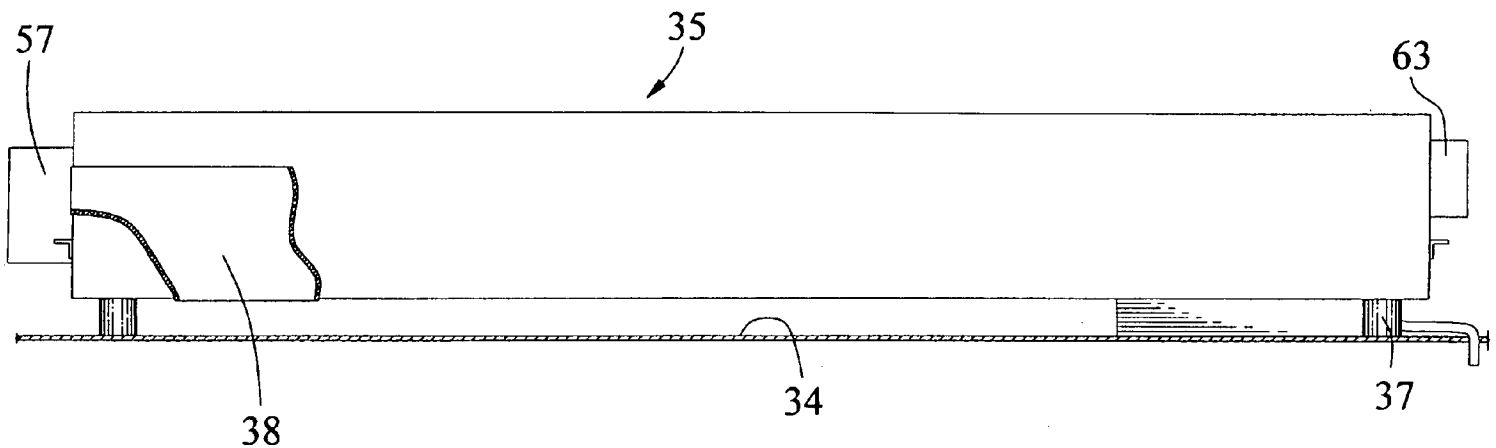
FIG. 6 is a right side elevational view.
Figure 7:
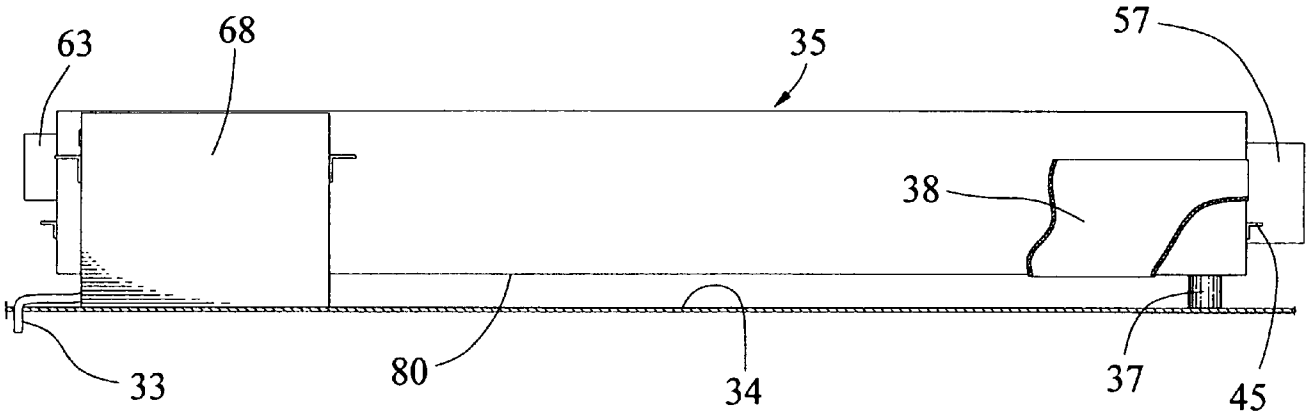
FIG. 7 is a left side elevational view.
Figure 8:
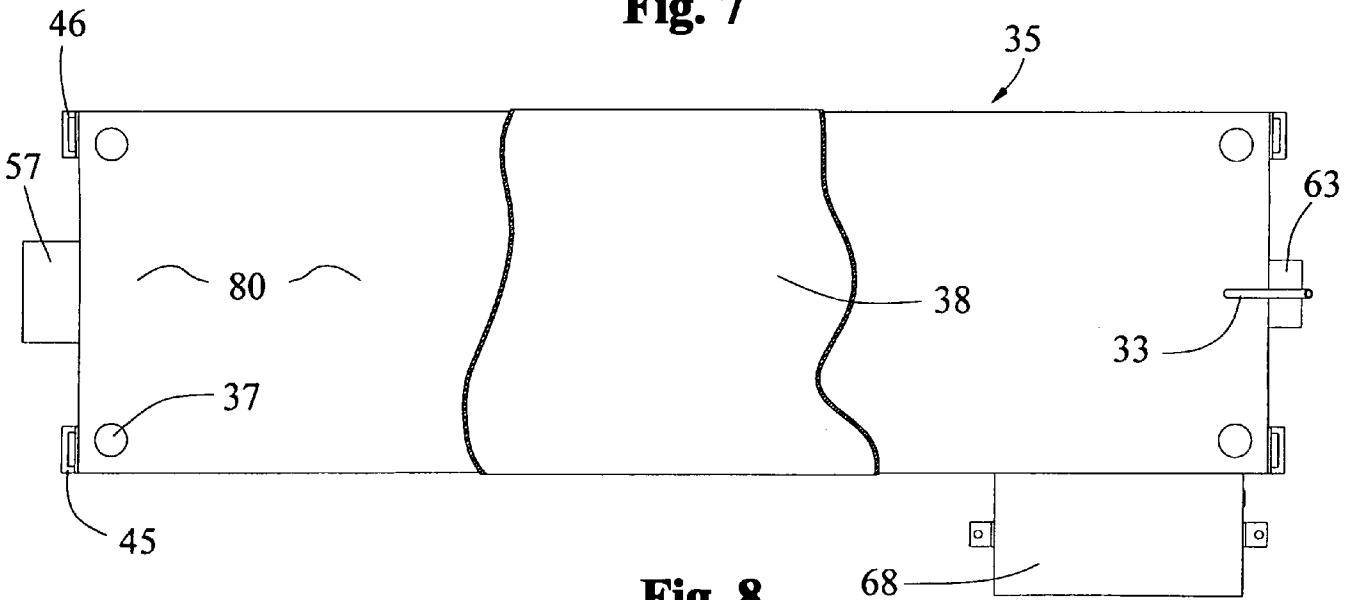
FIG. 8 is an enlarged, fragmentary bottom plan view.

Referencing FIGS. 5 and 6, airflow though the base compartment 36 is represented by arrows 98. Airflow velocity increases in the fan compartment 87 increases as indicated by airflow arrows 100 in the vicinity of shrouds 94 (FIGS. 2, 5) and 95. Air enters inlet 57, travels through the various cooling compartments penetrating orifices 92 in the partition walls between compartments, and exits the motor compartment 87 around the shroud segments 94 and exits through outlet coupling 63.

With reference now to FIGS. 12-16, the battery box 68 has a removable top 111. The generally rectangular upper surface 113 has a pair of spaced apart tabs 114 with orifices 115 for mounting with fastener 119 (FIG. 16) whose threaded ends are secured by standard bolts 120. Orifice 117 mounts the push button switch 70 (FIG. 1) disused earlier. Top 111 has downwardly depending ends 122 and sides 123 that tightly constrain the battery box when assembled Referencing FIGS. 17-24, orifices 130, 131 and 132 are defined in the cover's top surface 134 to flexibly mount the three cooling canisters 50-52 discussed earlier. Each orifice 130-132 has a periphery that is coaxially bounded by a captivated, resilient friction rings 136 made of flexible rubber or plastic. When the canisters are forced downwardly into their compartments, they will frictionally abut rings 136 for support. The canisters are cradled by a plurality of radially spaced apart, vertical supports 139 that are integral with adjacent heat exchange fins 142. Preferably the supports comprise J-hooks. As best viewed in FIG. 19, the bottoms of the J-hook supports 139 are oriented outwardly from the center, and are flexibly constrained together by an encircling, elastic band 144 that can comprise a rubber O-ring or the like. Thus when canisters 50-52 are pushed into place, they yieldably deflect the J-hooks 139, and are gently embraced by pressure form the elastic band 144. Thus they are firmly gripped about their periphery, but a degree of flexure is enabled. The bottom of each canister has a conventional peripheral lip 153 that is forced below the bottoms of the J-hooks 139, passing underneath the J-hook bottoms 159 (FIG. 119). As the canister lip 153 passes beneath the J-hook bottoms 159, a "detent" is formed, as the encircling and constrictive elastic band 144 yieldably expands to let the canister pass the J-hooks and "snap-fit" and "seat" properly. The band 144 "pops" the J-hooks into firm engagement with the canister sides when lip 153 passes the J-hook structure during canister insertion. This arrangement also facilitates a "quick change" effect where the cooling canisters can be speedily removed, refilled, and reinserted with mere finger or hand pressure, without special tools, where necessary.

Figure 19:
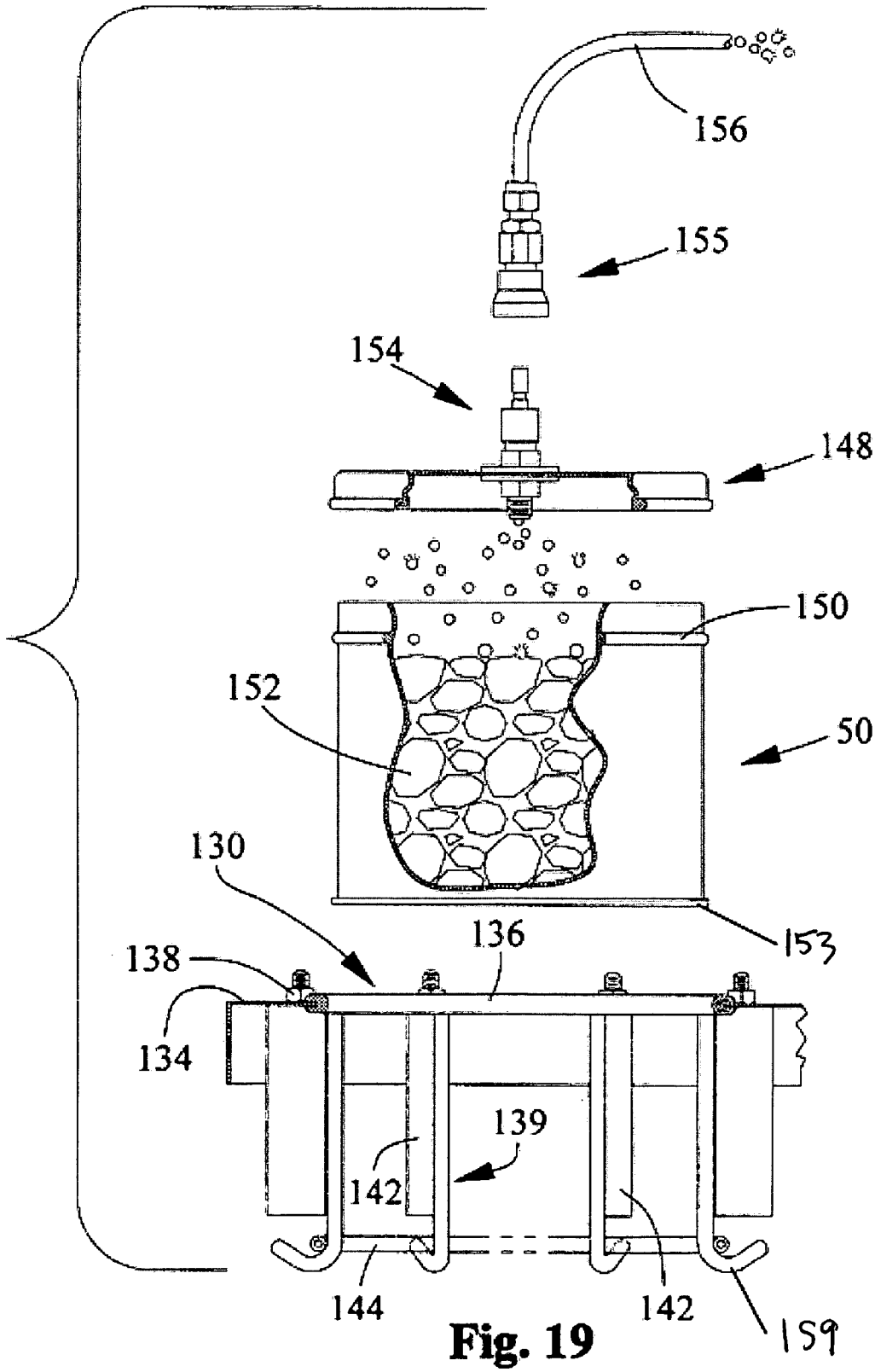
FIG. 19 is a partially exploded, sectional view of the housing cover taken along line 19-19 of FIG. 17.
Figure 20:
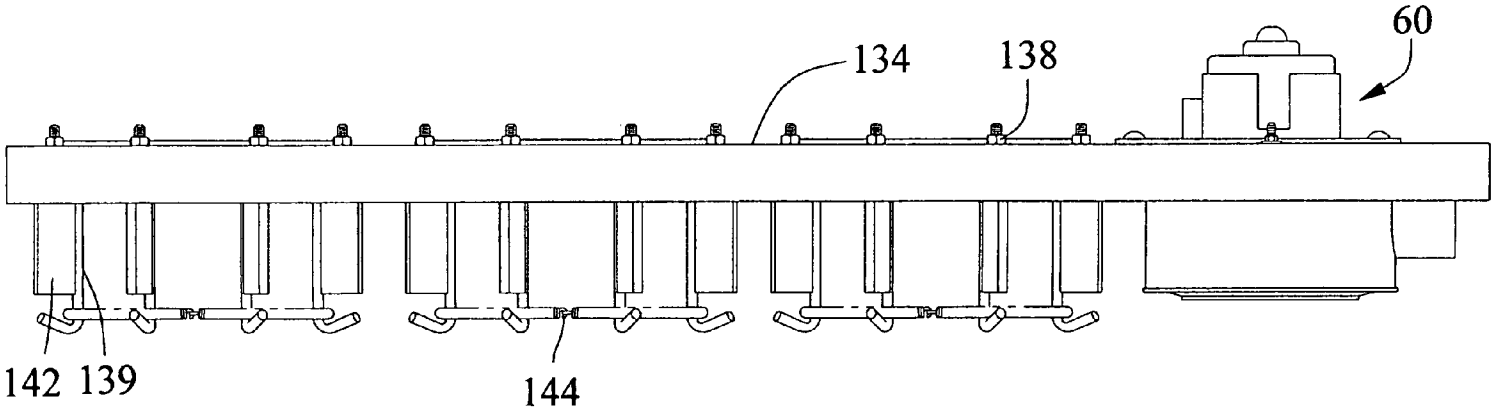
FIG. 20 is a side elevational view of the housing cover.
Figure 21:
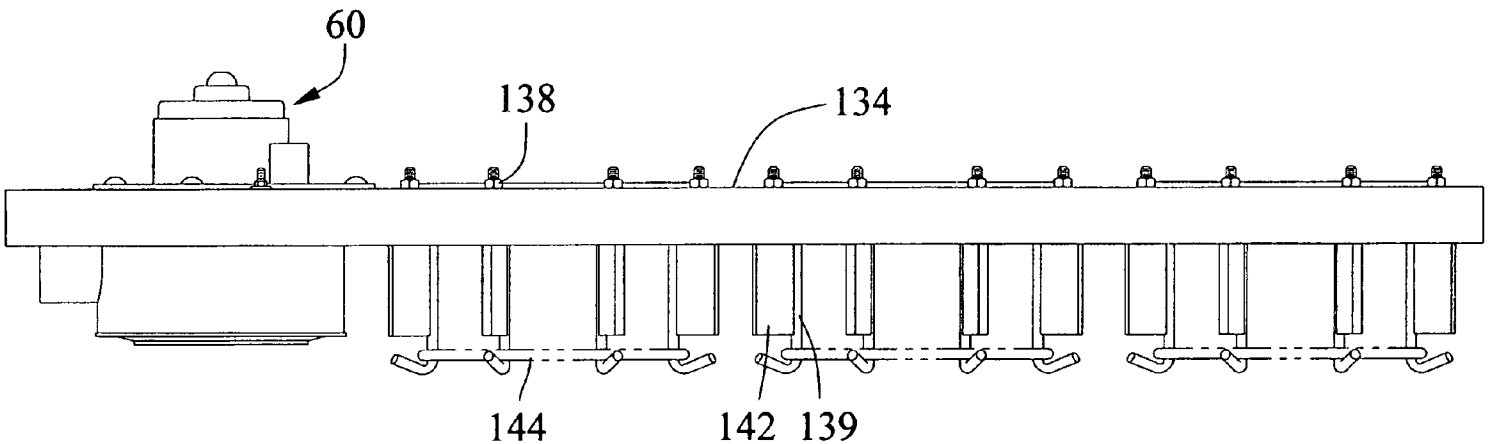
FIG. 21 is an elevational view of the side opposite that of FIG. 20.
Figure 22:
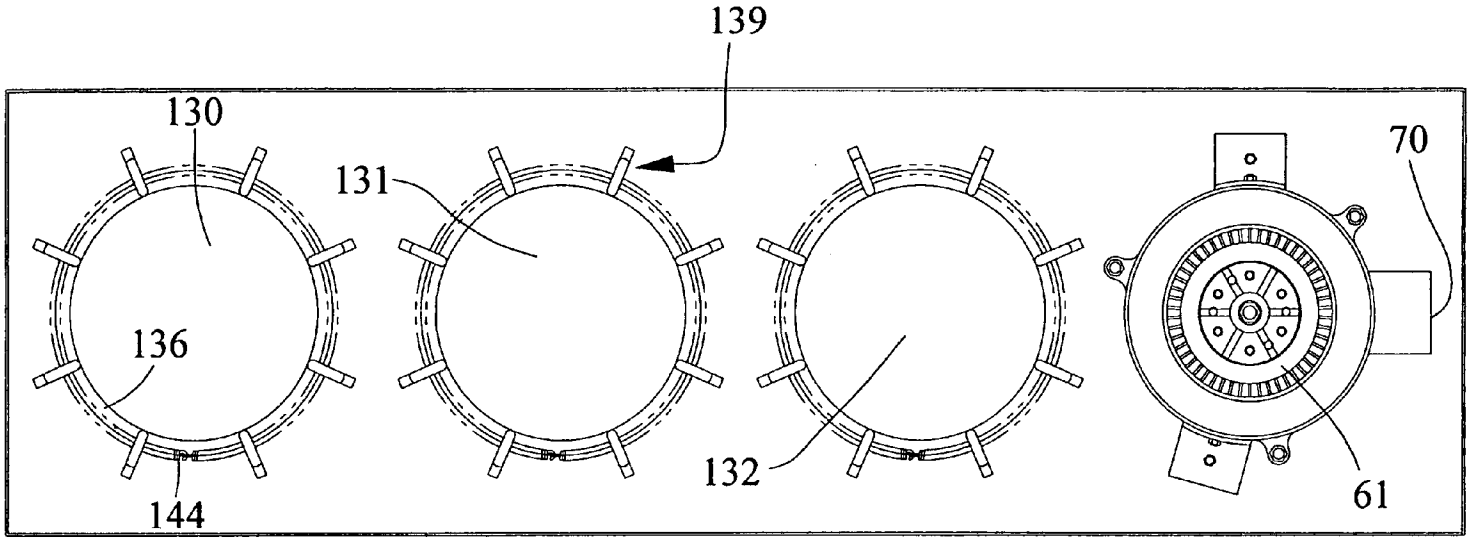
FIG. 22 is a bottom plan view of the preferred housing cover.
Figure 24:
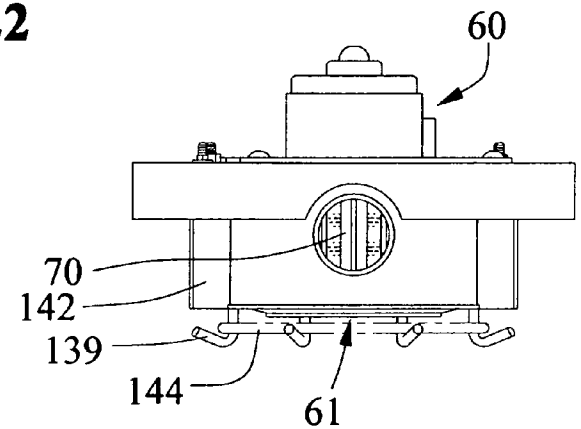
FIG. 24 is a right end elevational view.
Figure 23:
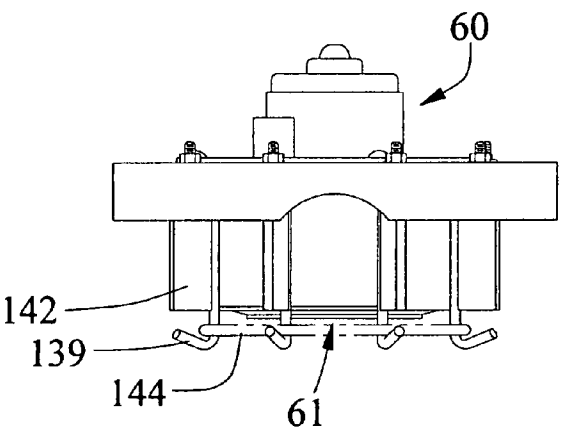
FIG. 23 is a left end elevational view.

In FIG. 19 it is seen that a typical canister 50 has a generally cylindrical shape. The canister tops have encircling beads 150 that enable the snap fitting of the similarly beaded tops 148. Preferably dry ice 152 is contained within each canister. The canister tops each have a quick-connect fitting 154 for interconnection with a hose fitting 155 that connects a venting hose 156 (FIG. 19) for discharging gaseous carbon dioxide as the dry ice 152 sublimates during cooling. Hoses 156 are routed distantly from the cooler, away from the driver, to minimize buildup of carbon dioxide gas.

Figure 25:
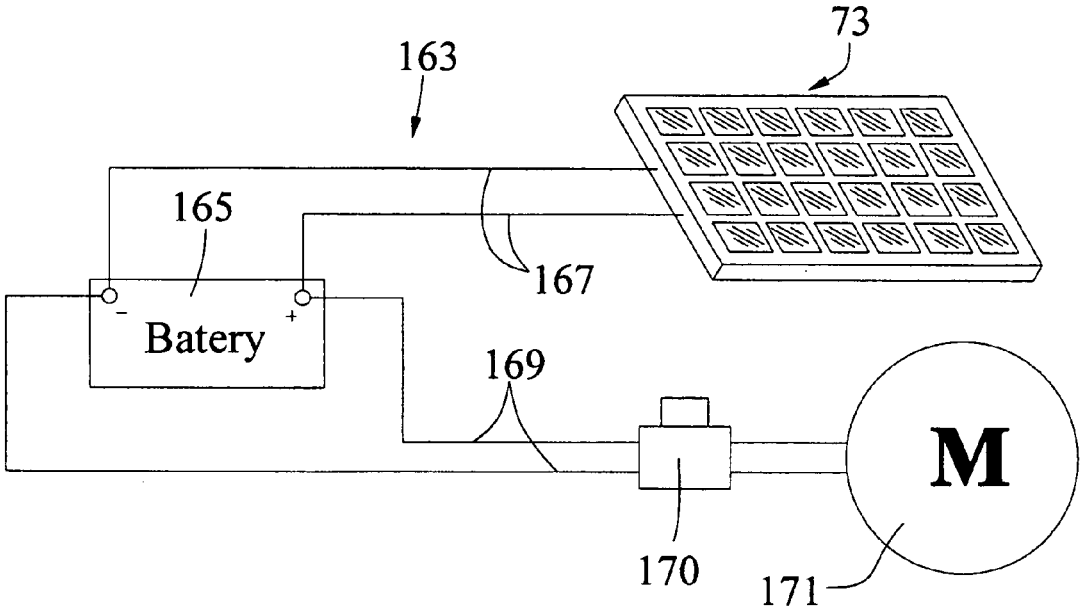
FIG. 25 is a electrical schematic diagram.

The wiring circuit 163 is seen in FIG. 25. A battery 165 is constrained within battery box 68 (FIG. 1) discussed earlier. The solar panel 73 connects across the battery terminals with lines 167. Output lines 169 are controlled by three-speed switch 70 to power the fan assembly motor 171.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable cooler comprising:

a rigid enclosure generally adapted to be disposed upon a supporting surface, the enclosure comprising an interior, an internal floor, a removable top for covering the interior, and an air inlet and an air outlet in fluid flow communication with said interior;

fan means for drawing air through said inlet into said interior and out of said interior via said outlet;

battery means for powering said fan means;

a plurality of baffles within said enclosure for dividing it into a fan compartment and a plurality of cooling compartments, the baffles each comprising a plurality of venting holes;

a plurality of canisters for storing a coolant, the canisters penetrating spaced-apart orifices defined in said enclosure top and entering said cooling compartments, the canisters comprising a body operationally disposed within said enclosure and lids disposed externally of said enclosure, the lids removably coupled to said canister bodies;

mounting means for resiliently and removably mounting said canisters to said enclosure, said mounting means comprising a plurality of radially spaced apart, vertically extending supports disposed about the peripheries of said orifices in said top and extending downwardly towards said cooling compartments, and an encircling elastic band for normally biasing the supports inwardly such that they firmly frictionally contact the surface of a canister when inserted.

2. The cooler as defined in claim 1 wherein said supports comprise J-hooks with curved bottoms adapted to clear a rim defined in bottoms of said canisters for forming a detent such that the canisters releasably snap fit to said cooler.

3. The cooler as defined in claim 2 further comprising means for removing condensate from said enclosure interior and means for venting carbon dioxide gas from said canisters.

4. The cooler as defined in claim 1 further comprising standoff means disposed upon said enclosure floor within each cooling compartment beneath a cooling canister for supporting canister weight and promoting heat exchange.

5. The cooler as defined in claim 4 wherein said standoff means comprise a plurality of spaced-apart, parallel rails with air passageways defined between them, the rails extending from said enclosure floor into contact with the bottoms of said cooling canisters.

6. The cooler as defined in claim 5 wherein the enclosure comprises a longitudinal centerline, and at least one set of venting holes in at least one of said baffles is offset from said centerline to form a serpentine air path through said enclosure for promoting heat exchange.

7. A cooler for comforting racecar drivers, the cooler comprising:

a rigid enclosure generally in the form of a parallelepiped that is adapted to be disposed upon a supporting surface, the enclosure comprising an interior, an internal floor, a centerline bisecting said interior, a removable top normally covering the interior, and an air inlet and an air outlet in fluid flow communication with said interior;

a plurality of baffles within said enclosure for dividing it into a fan compartment and a plurality of adjacent cooling compartments, the baffles each comprising a plurality of venting holes;

fan means for drawing air through said inlet into said interior and out of said interior via said outlet;

battery means for powering said fan means;

a plurality of canisters for storing a coolant, the canisters penetrating spaced-apart orifices defined in said enclosure top, the canisters comprising a body normally disposed within said enclosure and lids removably coupled to said canister bodies disposed externally of said enclosure;

means for resiliently snap-fitting said canisters to said enclosure, said mounting means comprising a plurality of radially spaced apart, vertically extending J-hooks disposed about the peripheries of said orifices in said top and extending downwardly towards said cooling compartments, and an encircling elastic band for normally biasing the J-hooks inwardly such that they firmly frictionally contact the surface of a canister when inserted;

hose means for conducting cooled air to said driver.

8. The cooler as defined in claim 7 wherein said J-hooks comprise curved bottoms adapted to clear a peripheral rim defined in bottoms of said canisters for forming a detent such that the canisters releasably snap fit to said cooler.

9. The cooler as defined in claim 8 further comprising means for removing condensate from said enclosure interior.

10. The cooler as defined in claim 8 further comprising means for venting carbon dioxide gas from said canisters.

11. The cooler as defined in claim 7 further comprising standoff means disposed upon said enclosure floor beneath said canisters for supporting canister weight and promoting heat exchange.

12. The cooler as defined in claim 11 wherein said standoff means comprise a plurality of spaced-apart, parallel rails with air passageways defined between them, the rails extending from said enclosure floor into contact with the bottoms of said canisters.

13. The cooler as defined in claim 7 wherein spaced-apart baffle orifices in different baffles are variably offset from said centerline to form a serpentine air path through said enclosure interior to promote heat exchange.

14. A cooler for comforting racecar drivers, the cooler comprising:

a rigid enclosure generally in the form of a parallelepiped that is adapted to be disposed upon a supporting surface, the enclosure comprising an interior, an internal floor, a centerline bisecting said interior, a removable top normally covering the interior, and an air inlet and an air outlet in fluid flow communication with said interior;

a plurality of baffles within said enclosure for dividing it into a fan compartment and separate, generally rectangular cooling compartments, the baffles each comprising a plurality of venting holes for passing air between adjacent compartments;

fan means associated with said fan compartment for drawing air through said inlet into said interior and out of said interior via said outlet;

battery means for powering said fan means;

a plurality of canisters for storing a coolant, the canisters comprising a cylindrical body normally disposed within said enclosure and lids removably coupled to the body;

receptacle means for receiving the canisters, the receptacle means comprising:

spaced-apart orifices defined in said enclosure top into which the cooling canisters are frictionally inserted;

friction rings coaxially fitted to said orifices;

a plurality of radially spaced apart, vertically extending J-hooks disposed about the peripheries of said orifices and extending downwardly towards said cooling compartments; and, an encircling elastic band for normally biasing the J-hooks inwardly such that they firmly frictionally contact the surface of a canister when inserted;

hose means for conducting cooled air to said driver.

15. The cooler as defined in claim 14 wherein said J-hooks comprise curved bottoms adapted to clear a peripheral rim defined in bottoms of said canisters for forming a detent such that the canisters releasably snap fit to said cooler.

16. The cooler as defined in claim 15 further comprising means for removing condensate from said enclosure interior.

17. The cooler as defined in claim 15 further comprising means for venting carbon dioxide gas from said canisters.

18. The cooler as defined in claim 15 further comprising standoff means disposed upon said enclosure floor beneath said canisters for supporting canister weight and promoting heat exchange.

19. The cooler as defined in claim 18 wherein said standoff means comprise a plurality of spaced-apart, parallel rails with air passageways defined between them, the rails extending from said enclosure floor into contact with the bottoms of said canisters.

20. The cooler as defined in claim 19 wherein spaced-apart baffle orifices in different baffles are variably offset from said centerline to form a serpentine air path through said enclosure interior to promote heat exchange.

* * * * *